United States Patent [19]

Yang

[11] Patent Number: 4,644,831

[45] Date of Patent: Feb. 24, 1987

[54] ADAPTOR SLEEVE

[76] Inventor: Miriam Yang, No. 23, Lane 240, Li Jen Road, Ta Li Hsiang, Taichung Hsien, Taiwan

[21] Appl. No.: 751,907

[22] Filed: Jul. 5, 1985

[51] Int. Cl.[4] ..... B25B 13/02; B25B 13/58

[52] U.S. Cl. ..... 81/125; 81/452; 81/439

[58] Field of Search ..... 81/451, 452, 177.85, 81/438, 125, 461, 439; 279/24, 79, 80, 102; 408/3; 269/287

[56] References Cited

U.S. PATENT DOCUMENTS

| | | | |
|---|---|---|---|
| 717,199 | 12/1902 | Hollm | 279/24 |
| 853,930 | 5/1907 | Miller | 81/177.85 |
| 1,056,848 | 3/1913 | Starrett et al. | 81/177.85 |
| 2,158,728 | 5/1939 | Peters | 279/24 |
| 2,677,294 | 5/1954 | Clark | 81/125 |
| 3,665,791 | 5/1972 | Carr | 81/125 |
| 3,935,762 | 2/1976 | Tudisco | 81/177.85 |

*Primary Examiner*—Frederick R. Schmidt
*Assistant Examiner*—Bradley I. Vaught
*Attorney, Agent, or Firm*—Sughrue, Mion, Zinn, Macpeak & Seas

[57] ABSTRACT

This present invention is an improved adaptor sleeve which includes a hollow sleeve having a first bore opening at its first end for receiving a coupling end of a handle and a second bore opening at its second end which has a hexagonal cross section adapted for receiving the head of a tool or screw driver. A U-shaped spring clamp plate is received in the second bore opening, and the U-shaped spring clamp plate is in an arrangement adapted for clamping and grasping the head of a tool or screw driver so that the head of a tool or screw driver cannot easily loosen off or rotate in the hollow sleeve during practical use.

3 Claims, 8 Drawing Figures

ADAPTOR SLEEVE

BACKGROUND OF THE INVENTION

This invention relates to an adaptor sleeve of a tool adaptor, particularly to an improved adaptor sleeve which can tightly clamp the head of a tool or a screw driver.

Among the adaptor sleeves of this type which have previously been known is one in which the head of a tool or a screw driver is easily loosened from the adaptor sleeve and may be inconvenient in practical use.

FIG. 1 and FIG. 2 show a prior design for an adaptor sleeve and its arrangement. The device includes a hollow sleeve having a first bore opening 11 at its first end for receiving a coupling end of a handle and a second bore opening 12 at its second end which has an annular groove 13 provided in the inner surface of the second end for receiving the spring member 14. The second bore opening 12 is adapted for receiving the head of a tool head or screw driver 15, and by the resilience of the spring member 14, the tool head or screw driver 15 is grasped in the second bore opening 12 of the hollow sleeve.

In practical use, there are some disadvantages in this type of adaptor sleeve in that, firstly, when manufacturing the adaptor sleeve, the respective specific sizes of the depth and width of the annular groove 13 are awkward to deal with. If its size is smaller than that of the spring member 14, the spring member 14 cannot be received in the groove 13. If the size is larger than that of the spring member 14, then it loses the resilience of the spring member 14 for grasping the head of a tool or screw driver. Secondly, placing the spring member 13 into the annular groove 13 is inconvenient in processing and wastes time in manufacturing. Finally, if the practical use, the groove 13 is larger than the spring member 14, the spring member 14 may rotate in the groove 13, and this makes for inefficiency when one is using this adaptor sleeve for tightening or loosening the screw. It is also easy to cause the spring to jam frequently against the head of a tool or a screw driver when the head of a tool or a screw driver is removed from the adaptor sleeve.

SUMMARY OF THE INVENTION

With the above disadvantages in view, the general object of the invention is to provide an improved adaptor sleeve which is simple in construction and will overcome the deficiencies and disadvantages of the prior arrangements.

It is a further object of this invention to provide an improved adaptor sleeve which can secure tightly the the head of a tool or a screw driver for convenience in practical use, and which also has the advantage over the prior arrangement of preventing the jamming of the head of a tool in the sleeve.

In order to achieve the aforesaid objects, as well as other incidental objects and advantages, the invention includes a hollow sleeve having a first bore opening at its first end adapted for receiving a coupling end of a handle and a second bore opening at its second end which has a hexagonal cross section adapted for receiving the head of a tool or screw driver. A U-shaped spring clamp plate received in the second bore opening of the hollow sleeve is adapted for clamping the head of a tool or a screw driver.

The second bore opening of the hollow sleeve has six interconnected inner surfaces in which two opposite inner surfaces are provided with two opposite recesses for securing the U-shaped spring clamp plate. The U-shaped spring clamp plate is arranged so that the middle portion of the two arms of the U-shaped spring clamp plate are slightly curved inward in order to secure the tool head tightly when the tool head is inserted into the hollow sleeve.

These and other objects, features and advantages of the present invention will be more apparent in the following description of a preferred embodiment with reference to the accompanying drawings, in which:

DETAILED DESCRIPTION OF THE PREFERRED EMBODIMENT

Figure 1:
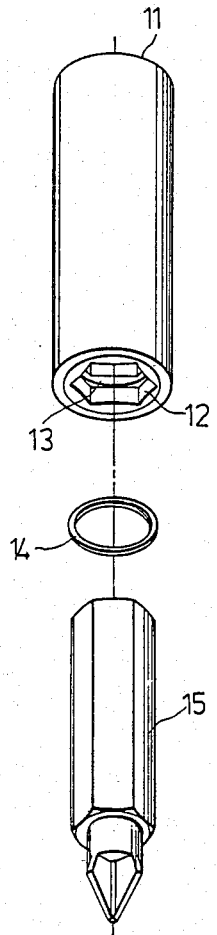
PRIOR ART FIG. 1
FIG. 1 is an exploded view of a prior design of an adaptor sleeve.
Figure 2:
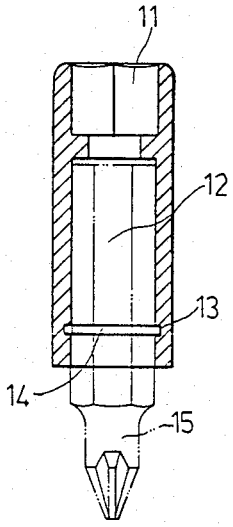
PRIOR ART FIG. 2
FIG. 2 is a side cross section view of FIG. 1 when the spring member and tool head is inserted into the sleeve.
Figure 3A:
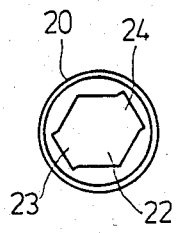
FIG. 3A is a bottom view of the second bore opening, according to the invention.
Figure 3:
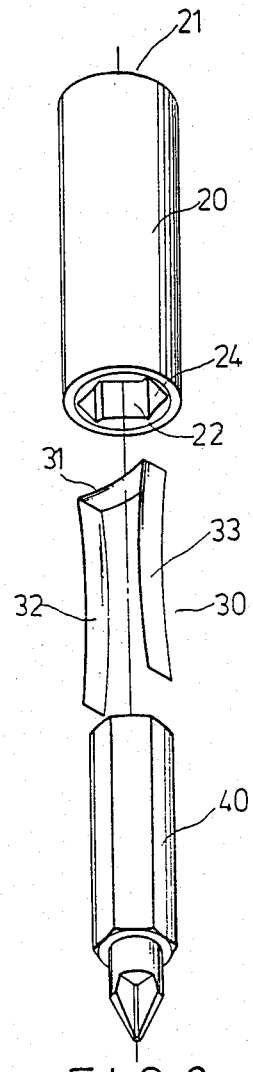
FIG. 3 is an exploded view of an embodiment.
Figure 4:
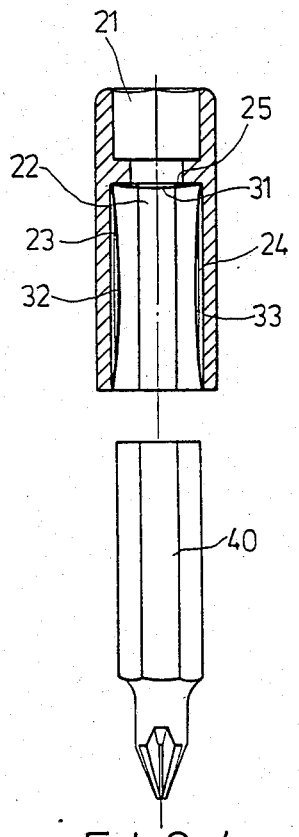
FIG. 4 is a side cross section view of the invention with the U-shaped spring clamp received in the adaptor sleeve.
Figure 5:
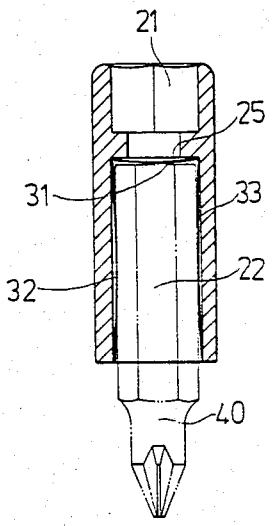
FIG. 5 is a side cross section view of the FIG. 4 when the head of a tool or a screw driver is received in the hollow sleeve according to the invention.

Referring to FIG. 3, FIG. 4 and FIG. 5, the invention includes a hollow sleeve 20, having a first bore opening 21 at its first end adapted for receiving a coupling end of a handle (not shown in the figures), and a second bore opening 22 at its second end, which has a hexagonal cross section adapted for receiving the head of a tool or screw driver 40. A U-shaped spring clamp plate 30 received in the second bore opening 22 of the hollow sleeve 20 is adapted for clamping the head of a tool or a screw driver 40.

Figure 6A:
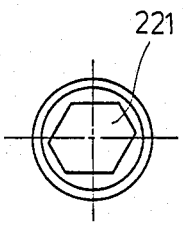
FIG. 6A is a bottom view of the second bore opening, of the invention.
Figure 6:
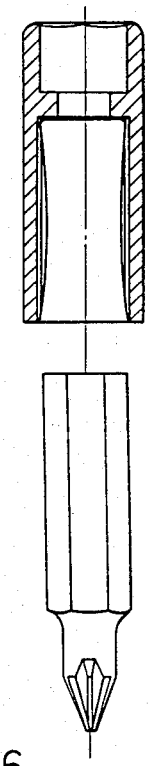
FIG. 6 is a side cross section view of another embodiment.

The second bore opening 22 of the hollow sleeve 20 has six interconnected inner surfaces in which two opposite inner surfaces define two opposite recesses 23, 24 for securing the U-shaped spring clamp 30. FIG. 6 is another embodiment of the invention showing that the second bore opening 221 is not provided with two opposite recesses on the opposite inner surfaces of the second bore opening 221.

The U-shaped spring clamp plate 30 is in an arrangement such that the length of the base portion 31 of the U-shaped clamp plate 30 is slightly greater than the distance between the recesses 23, 24, and the middle portions of the two arms 32, 33 of the U-shaped spring clamp plate 30 are slightly concave or curved inwardly.

Because of the above-described arrangement, the base portion 31 of the U-shaped clamp plate 30 bends slightly inwards when the U-shaped clamp plate 30 is inserted into the hollow sleeve 20, and causes the arm portions 32, 33 of the U-shaped spring clamp plate 30 to have a resilience for tightly securing and grasping the head of a tool or screw driver 40 when the head of a tool or a screw driver 40 is inserted into the hollow sleeve 20.

The base portion 31 of the U-shaped spring clamp plate 30 is welded to an integral protrusion or shoulder 25 of the inner surface of the hollow sleeve to secure the spring clamp 30.

While this invention has been described with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

What is claimed is:

1. An improved adaptor sleeve which comprises:

a hollow sleeve member having a first and a second end, having a first bore opening at said first end for receiving a coupling end of a handle, and having at said second end a second bore opening which has an inner wall of a hexagonal cross section for receiving the head of a tool or screw driver; and a U-shaped spring clamp plate, entirely received in said second bore opening of said hollow sleeve, for clamping the head of a tool or a screw driver, the U being formed by a base portion and two arm portions; said base portion being disposed between said first and second bore openings such that said base portion is positioned between said head and said first bore opening when said head is received in said second bore opening;

said second bore opening having two opposite inner surfaces, and said base portion of said U-shaped spring clamp being slightly longer than the distance between said opposite inner surfaces of said second bore opening;

said arm portions of said U-shaped spring clamp extending in the direction from said first bore opening to said second bore opening and having middle portions which are slightly curved inwardly toward the center of the U, each of said arm portions having only a single curve.

2. An improved adaptor sleeve as claimed in claim 1, wherein said second bore opening of said hollow sleeve has six interconnected inner surfaces including said two opposite inner surfaces which define two opposite recesses for securing said U-shaped spring clamp plate.

3. An improved adaptor sleeve as claimed in claim 1, wherein said inner wall of said sleeve has an integral shoulder, and wherein the base portion of said U-shaped spring clamp plate is welded to said shoulder for fixing and securing said U-shaped spring clamp plate.

* * * * *